US006116540A

United States Patent [19]

Arata

[11] Patent Number: 6,116,540

[45] Date of Patent: Sep. 12, 2000

[54] AIRCRAFT VERTICAL TAIL WITH SHADOWED BASE

[75] Inventor: Allen A. Arata, Hawthorne, Calif.

[73] Assignee: Northrop Grumman Corporation, Los Angeles, Calif.

[21] Appl. No.: 09/310,405

[22] Filed: May 12, 1999

[51] Int. Cl.[7] ..... H01Q 17/00

[52] U.S. Cl. ..... 244/87; 244/91; 244/117 R; 244/123; 342/2

[58] Field of Search ..... 244/87, 91, 35 R, 244/117 R, 119, 123, 198, 199; 342/2, 4

[56] References Cited

U.S. PATENT DOCUMENTS

| | | | |
|---|---|---|---|
| Re. 36,298 | 9/1999 | Scherrer et al. | 342/2 |
| D. 332,080 | 12/1992 | Sandusky, Jr. et al. | D12/342 |
| 3,487,410 | 12/1969 | Barnett et al. | 343/18 |
| 3,592,414 | 7/1971 | Aulehla et al. | 244/55 |
| 4,019,699 | 4/1977 | Wintersdorff et al. | 244/121 |
| 4,354,646 | 10/1982 | Raymer | 244/87 |
| 4,924,228 | 5/1990 | Novak et al. | 342/2 |
| 5,014,060 | 5/1991 | Novak et al. | 342/2 |
| 5,096,143 | 3/1992 | Nash | 244/87 |
| 5,250,950 | 10/1993 | Scherrer et al. | 342/2 |
| 5,276,447 | 1/1994 | Shingo | 342/2 |
| 5,488,372 | 1/1996 | Fischer | 342/5 |

*Primary Examiner*—J. Woodrow Eldred

*Attorney, Agent, or Firm*—Terry J. Anderson; Karl J. Hoch, Jr.

[57] ABSTRACT

In accordance with the present invention, there is provided a low observable aerodynamic control system for integrated use with an aircraft fuselage. The control system is provided with a shadow structure having an inner sloping region and an outer sloping region. The inner sloping region defines a shadow structure concavity. The outer sloping region is attachable to the aircraft fuselage. The control system is further provided with an aerodynamic control device having a body portion and a base portion. The base portion is disposed within the shadow structure concavity. The body portion extends from the base portion beyond the shadow structure concavity.

29 Claims, 3 Drawing Sheets

AIRCRAFT VERTICAL TAIL WITH SHADOWED BASE

FIELD OF THE INVENTION

The present invention relates generally to aircraft aerodynamic control surfaces, and more particularly to a control device configured to have a mitigated radar observable signature.

BACKGROUND OF THE INVENTION

Conventional fixed winged aircraft are provided with a variety of aerodynamic control surface devices which include, for example, flaps, elevators, ailerons, trim tabs, and rudders. These control surface devices cooperatively operate to increase or decease lift over a given localized aerodynamic control surface for achieving pitch, yaw and roll control of the aircraft. These control surface devices are typically rigid structures which are rotatably attached to the wings or body (i.e., aerodynamic lifting surfaces) of the aircraft in a hinge-like fashion. Operation of the control surface devices typically forms gaps and/or abrupt changes in surface contours at or about the hinge line. Such gaps and abrupt changes are undesirable for a number of reasons. The gaps and abrupt changes tend to increase the radar signature of the aircraft, tend to increase aerodynamic drag, and give rise to the potentiality that foreign objects and/or debris may become caught thereat.

A classical aerodynamic control surface device includes a rudder which is hingedly attached to an aircraft vertical tail. Such a device configuration is highly aerodynamically efficient for providing directional yaw stability and control. In terms of radar cross section (RCS) signature, however, such configuration tends to undesirably increase the aircraft observability. In this respect, the vertical tail typically has a base portion which is attached to a topmost section of the aircraft fuselage or wing. At this base portion, the transition from the vertical tail to the fuselage or wing tends to create certain abrupt surface contour changes which increase the aircraft radar signature. In addition, the rotational attachment of the rudder to the vertical tail creates a hinge line which further increases the aircraft radar signature.

Some stealthy aircraft designs have avoided incorporation of the highly observable vertical tails in favor of less radar observable aerodynamic control systems. A contemporary example of such a design is the U.S. Military's B-2 bomber. These alternate designs may obtain direction control by means such as drag rudders at the wing tips or by thrust vectoring. While such control systems may have an associated mitigated radar signature, they also tend to be complex and not as aerodynamically efficient as the classic vertical tails.

It is therefore evident that there exists a need in the art for an aircraft aerodynamic control system which tends to be aerodynamically efficient while mitigating aircraft radar cross section signature by mitigating in comparison to conventional control designs.

SUMMARY OF THE INVENTION

In accordance with the present invention, there is provided a low observable aerodynamic stability and control system for integrated use with an aircraft fuselage. The control system is provided with a shadow structure having an inner sloping region and an outer sloping region. The inner sloping region defines a shadow structure concavity. The outer sloping region is attachable to the aircraft fuselage. The control system is further provided with an aerodynamic control device having a body portion which preferably takes the form of an aircraft vertical tail. The control device further has a base portion which is disposed within the shadow structure concavity. The body portion extends from the base portion beyond the shadow structure concavity.

In the preferred embodiment of the aerodynamic control system of the present invention, the shadow structure is generally oval-shaped as it encompasses the aerodynamic control device. The shadow structure further has an oval-shaped apex region which interposed between the inner and outer sloping regions. The aircraft fuselage generally defines a horizontal plane and the base portion is disposed below the apex region with respect to the horizontal plane. The aerodynamic control device further has a contour transition portion which defines the intersection between the body and base portions. The apex region and the contour transition portion are cooperatively sized and configured to define positive angles with respect to the horizontal plane.

In this respect, the contour transition portion is submerged within the concavity of the shadow structure. The contour transition portion is advantageously obscured from view at specific angles. It is contemplated that the contour transition portion tends to have undesirable radar reflectivity characteristics associated therewith. As such, the particular shaping and placement of the shadow structure alters the viewing/reflecting angle at which radar signals have a direct line-of-sight. The present invention recognizes that during flight, radar observation stations are disposed below an aircraft. In the absence of the shadow structure, under a wide range of bank or elevation angles of the aircraft, the transition portion would be exposed to such ground based radar observation stations. Through the incorporation of the shadow structure, however, the contour transition portion is obscured from radar view over a broader range of bank and/or pitch angles. In this regard, the present invention facilitates a widening the fight envelope in which the associated aircraft may maneuver while maintaining a relatively low observability of the aerodynamic control device, and in particular the contour transition portion thereof.

The aircraft fuselage is generally defined by a longitudinal axis disposed within a horizontal plane. The body portion of the control device is generally disposed vertically, and thus aligned perpendicular to the longitudinal axis. In the preferred embodiment of the present invention, body portion is configured to rotate about a generally vertical axis (i.e., orthogonal to the longitudinal axis). Thus, the body portion may rotate relative to the aircraft fuselage, and thus the shadow structure as well. In this respect, the body portion may function as a rudder on a traditional aircraft tail, without the associated highly radar observable rudder hinge line. It is contemplated that where the control device is not configured to rotate, such control device functions to provide stability control. Whereas, with the control device being configured to rotate, such control device may additionally function in an active aerodynamic control capacity.

Advantageously, in order to further mitigate radar observability, the shadow structure and the aerodynamic control device may be formed of a radar absorptive material. Further, the outer sloping region of the shadow structure may be formed to attach to the aircraft fuselage to form a relatively smooth airfoil surface thereat. This is not only aerodynamic, but further mitigates the emission of undesirable radar signals.

As such, based on the foregoing, the present invention mitigates the inefficiencies and limitations associated with prior art aerodynamic aircraft control systems. Accordingly, the present invention represents a significant advance in the art.

BRIEF DESCRIPTION OF THE DRAWINGS

These, as well as other features of the present invention, will become more apparent upon reference to the drawings wherein.

DETAILED DESCRIPTION OF THE PREFERRED EMBODIMENT

Figure 1:
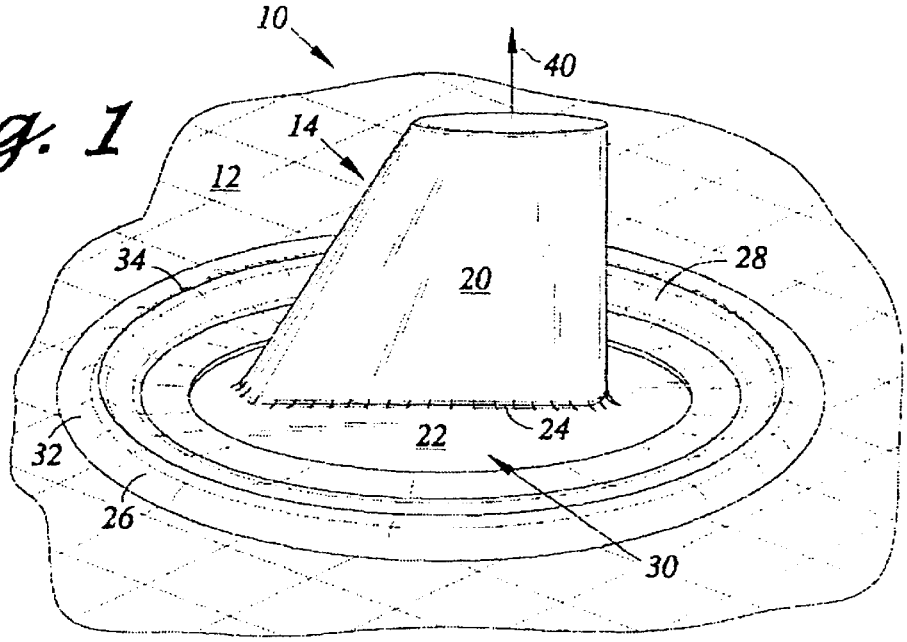
FIG. 1 is a top perspective view of the aerodynamic control system of the present invention.
Figure 2:
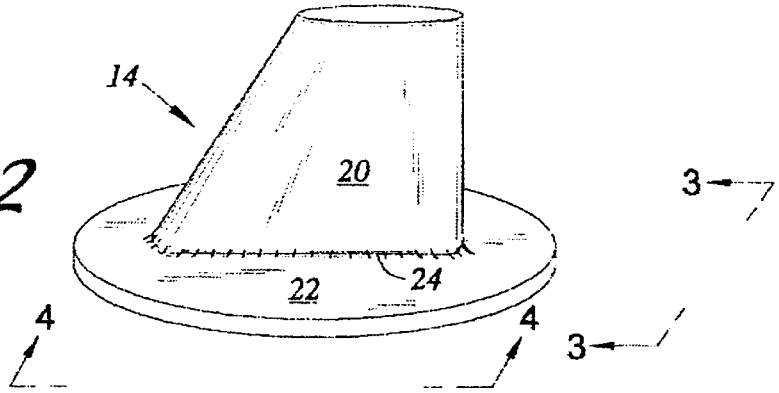
FIG. 2 is a perspective view of the aerodynamic control device of the control system of FIG. 1.
Figure 3:
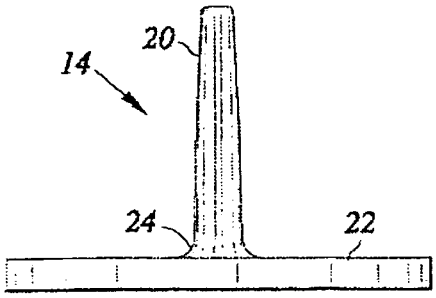
FIG. 3 is a rear view of the aerodynamic control device as seen along axis 3—3 of FIG. 2.
Figure 4:
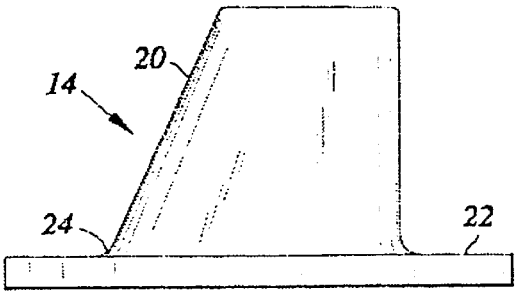
FIG. 4 is a side view of the aerodynamic control device as seen along axis 4—4 of FIG. 2.
Figure 5:
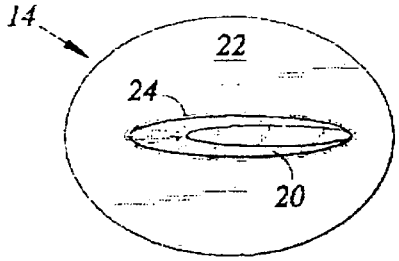
FIG. 5 is a top view of the aerodynamic control device of FIG. 2.

Referring now to the drawings wherein the showings are for purposes of illustrating a preferred embodiment of the present invention only, and not for purposes of limiting the same, FIGS. 1–8 illustrate an aerodynamic control system for an aircraft which is constructed in accordance with the present invention. As will be described in more detail below, the aerodynamic control system is particularly suited for mitigating an observable radar signature associated with the aircraft.

In accordance with the present invention, referring now to FIGS. 1–8, there is provided a low observable aerodynamic control system 10 for integrated use with an aircraft fuselage 12. The fuselage 12 may take the form of a traditional shaped main body portion of an aircraft, but may also take the form of a blended fuselage/wing structure as in the case with modern stealthy designs. The control system 10 is provided with an aerodynamic control device 14 which extends from the aircraft fuselage 12. The aircraft fuselage 12 defines a horizontal reference plane 16 with respect to the aerodynamic control device 14. In this respect, the aerodynamic control device 14 extends from the horizontal reference plane 16. The aircraft fuselage 12 further defines a longitudinal axis 18 which is disposed within the horizontal reference plane 16.

The aerodynamic control device 14 is generally provided with a body portion 20 which extends from the aircraft fuselage 12. The body portion 20 defines an surface contour with is sized and configured to influence aerodynamic lift and/or drag thereat to therefore provided aerodynamic control to the associated aircraft. In the preferred embodiment of the present invention, the aerodynamic control device 14 generally takes the form of an aircraft tail. In this respect, the body portion 20 may be disposed generally along the longitudinal axis 18 and orthogonal or perpendicular to the horizontal reference plane 16 of the aircraft fuselage 12 as depicted. It is contemplated, however, that the body portion 20 may be angularly disposed and/or have a curved configuration which is biased in an angular direction. The control device 14 is further provided with a base portion 22. The base portion 22 is preferably sized and configured to be perpendicular to the body portion 20 and thus is generally parallel to the horizontal reference plane 16. Preferably, the control device 14 has a contour transition portion 24 which is disposed generally between the body and base portions 20, 22 thereof.

The aerodynamic control system 10 is provided with a shadow structure 26 which is disposed adjacent the aircraft fuselage 12. It is contemplated that the may be integrally formed with the aircraft fuselage 12 or retrofitted with a traditional aircraft fuselage design. The shadow structure 26 is provided with an inner sloping region 28 which defines a shadow structure concavity 30. The shadow structure 26 is further provided with an outer sloping region 32. The outer sloping region 32 is sized and configured to be attachable to the aircraft fuselage 12. Preferably, the outer sloping region 32 is attachable to the aircraft fuselage 12 to form a relatively smooth airfoil surface thereat. Thus, the surface contour of the aircraft fuselage 12 blends or transitions to the curvature of the outer sloping region 32. As one of ordinary skill in the art will appreciate, such smooth integration is desirable in both terms of aerodynamic design and a mitigated radar signature. The shadow structure 26 is preferably provided with an apex region 34 which is interposed between the inner and outer sloping regions 28, 32.

Importantly, the base portion 22 of the aerodynamic control device 14 is disposed within the shadow structure concavity 30. The shadow structure 26 is configured to have a curvature for capturing the aerodynamic control device 14. In this respect, the body portion 20 extends from the base portion 22 beyond the shadow structure concavity 30 with respect to the horizontal reference plane 16. The base portion 22 is disposed below the apex region 34 of the shadow structure 26 with respect to the horizontal reference plane 16. The apex region 34 of the shadow structure 26 and the contour transition portion 24 of the aerodynamic control device 14 are cooperatively sized and configured to define positive angles with respect to the horizontal reference plane 16.

As surface contour angulation generally tends to have an increased radar reflectivity, it is contemplated that the general region between the aircraft fuselage 12 and the body portion 20 of the aerodynamic control device 14, and in particular the contour transition portion 24, tends to have undesirable radar reflectivity characteristics associated therewith. The particular shaping and placement of the shadow structure 26, however, alters the viewing/reflecting angle at which radar signals have a direct line-of-sight thereof.

Figure 6:
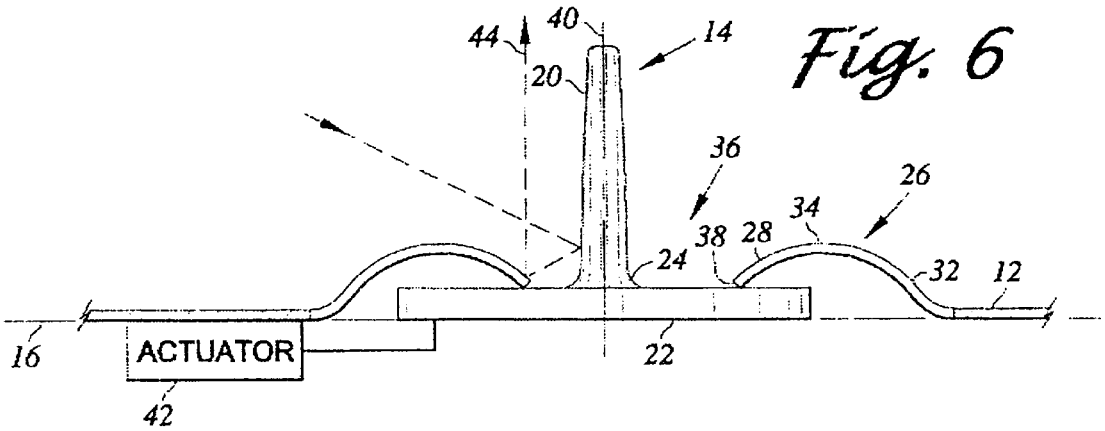
FIG. 6 is a cross-sectional rear view of the aerodynamic control system of FIG. 1.
Figure 7:
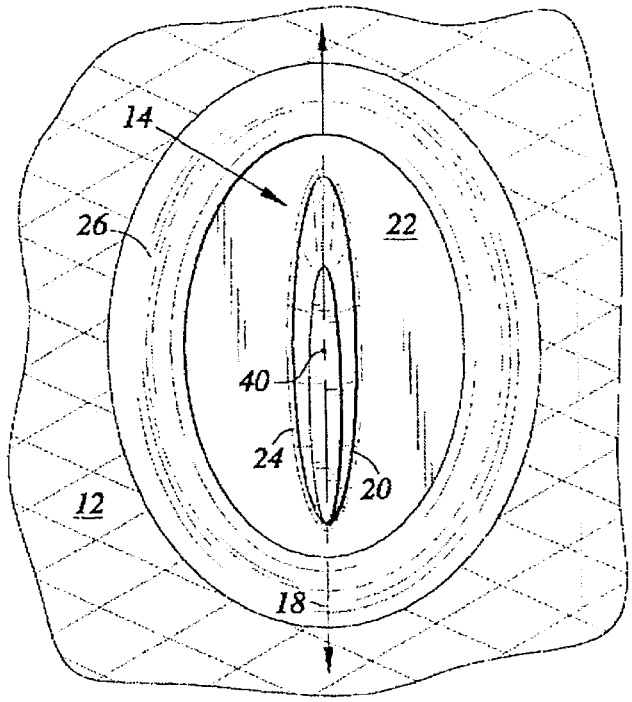
FIG. 7 is a top view of the aerodynamic control system of FIG. 1.
Figure 8:
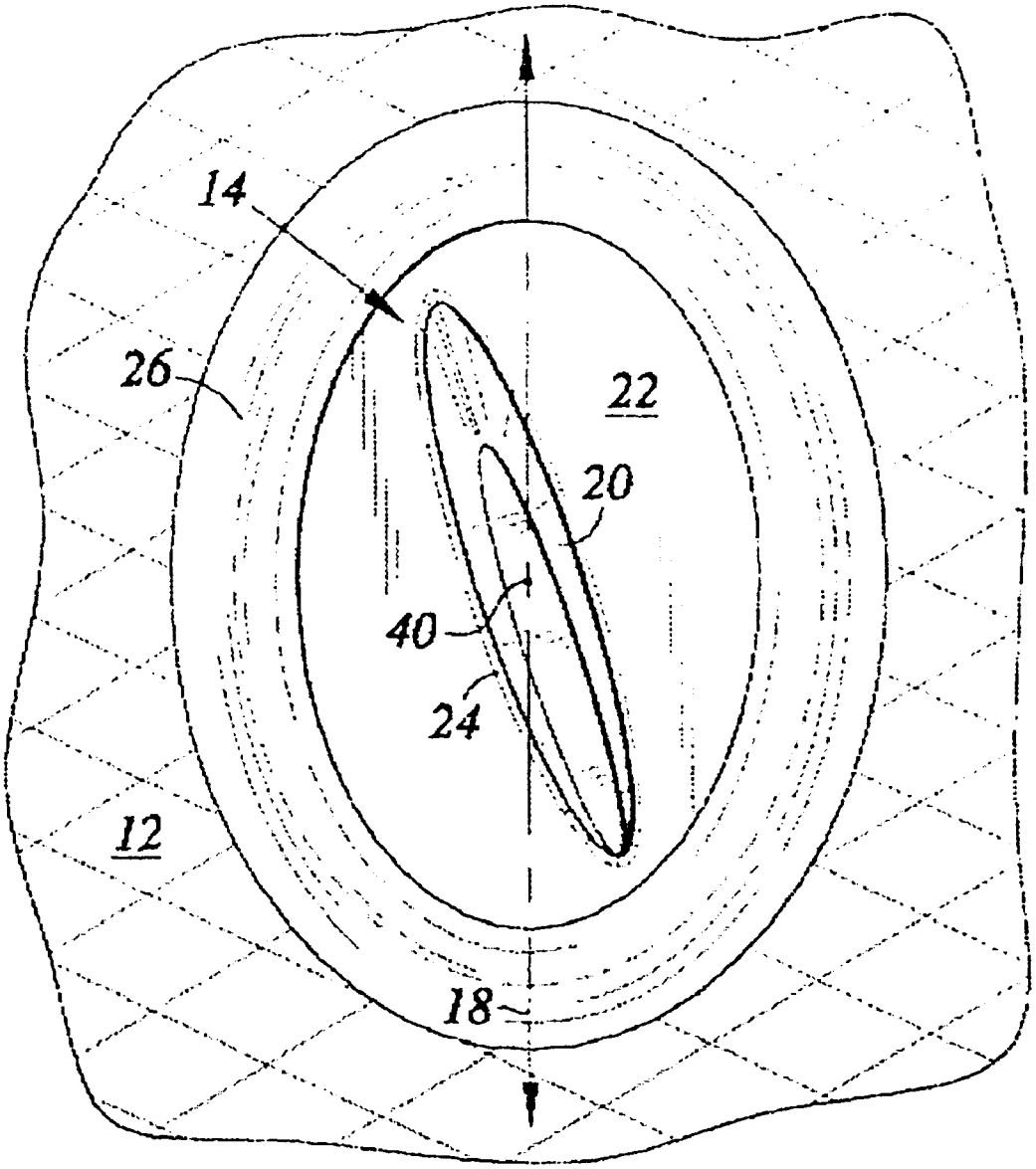
FIG. 8 is a similar top view of the aerodynamic control system of FIG. 7 with the control device in a rotated position.

The present invention recognizes that during flight, radar observation stations are disposed below an aircraft (i.e., from below the horizontal reference plane 16). In the absence of the shadow structure 26, under a wide range of bank or elevation angles of the aircraft, the general region between the aircraft fuselage 12 and the body portion 20 of the aerodynamic control device 14, and in particular the contour transition portion 24, would be exposed to such ground based radar observation stations. Through the incorporation of the shadow structure 26, however, the contour transition and base portions 24, 22 are obscured from radar view over a broader range of bank and pitch angles. In this respect, radar signals having a direct line-of-sight of the contour transition portion 24 must emanate from a point which is above a line defined by the contour transition portion 24 and the apex portion 34 of the shadow structure 26. Moreover, it is further contemplated that even though such radar signals may have a direct line-of-sight which the contour transition portion 24, the radar signals must have a reflection path back towards their source in order to be effective. In this respect, it is contemplated that the shadow structure 26 is useful in blocking or otherwise redirecting reflected radar signals thereat. Referring to now to FIG. 6 there is depicted an exemplar reflected radar signal path 44. As is depicted, the reflected radar signal path 44 follows path which initially avoids the shadow structure 26 and impinges upon the contour transition portion 24. The reflected radar signal path 44, however, is then depicted as being reflected upon the inner sloping region 28 of the shadow structure 26 and is thereafter redirected in direction away from the initial source direction.

The aircraft fuselage 12 generally defines a control device opening 36. The control device opening 36 has a periphery 38 which is generally aligned parallel to the horizontal reference plane 16. the device opening 36 and the periphery 38 thereof may be configured in a generally oval shape, however, other shapes are contemplated such as dumbbell and circular shapes. The shadow structure 26 is disposed to generally surround the control device opening 36. In this respect, the shadow structure 26, and in particular, the apex portion 34 thereof, may be generally oval-shaped. As such, the body portion 20 of the aerodynamic control device 14 is configured to extend through the shadow structure 26 and the control device opening 36 of the aircraft fuselage 12. It is contemplated, however, that the shadow structure 26 and the apex region 34 thereof are not required to completely circumscribe the control device opening 36. At the least, it is preferable that the shadow structure 26 is disposed along side the aerodynamic control device 14. In this regard, the shadow structure 26 may take the form of a pair of opposing shadow structures which are generally elongate convex-shaped and extend along the width of the body portion 20 parallel to the longitudinal axis 18. Thus, a cross-sectional view of a portion of the shadow structure 26 along side the aerodynamic control device 14 reveals that the shadow structure 26 may be generally described as being locally convex, as best seen in FIG. 6. It is contemplated that the shadow structure 26 may be formed in sections or as a unitary structure.

Advantageously, in order to further mitigate radar observability, the shadow structure 26 and the aerodynamic control device 14 may be selectively formed of a radar absorptive, reflective or transparent material. It is contemplated that the particular material selections for the shadow structure 26 and the control device 14 are chosen from those which are well known to one of ordinary skill in the art.

In the preferred embodiment of the present invention, the aerodynamic control device 14 is sized and configured to rotate about an axis of rotation 40. It is contemplated that where the control device 14 is not configured to rotate, such control device functions to provide stability control. Whereas, with the control device 14 being configured to rotate, such control device 14 may additionally function in an active aerodynamic control capacity. Where the control device 14 takes the form of an aircraft tail, the axis of rotation 40 may be generally orthogonal to the longitudinal axis 18 of the aircraft fuselage 12. In this regard, referring now to FIGS. 7 and 8, the control device 14 is depicted in its normal position which is generally aligned with the longitudinal axis 18 and in a rotation position. It is contemplated that selective rotation of the aerodynamic control device 14 relative to the shadow structure 26 and thus the aircraft fuselage 12 facilitates control of the associated aircraft. In practice there is provided an actuator 42 which is mechanically engaged with the control device 14 for rotating the same (the actuator 42 is symbolically depicted in FIG. 6). The actuator 42 may be chosen from those device which are well known to one of ordinary skill in the art. Preferably, the base portion 22 of the aerodynamic control device 14 is sized and configured to slidably engage the periphery 38 of the control device opening 36. The periphery 38 may be configured to overlap the base portion 22 of the control device 14 to mitigate any gaps or other aerodynamic inefficiencies thereat.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. A low observable aerodynamic control system for integrated use with an aircraft fuselage, the control system comprising:

a shadow structure having an inner sloping region and an outer sloping region, the inner sloping region defining a shadow structure concavity, the outer sloping region being attachable to the aircraft fuselage; and an aerodynamic control device having a body portion and a base portion, the base portion being disposed within the shadow structure concavity, the body portion extending from the base portion beyond the shadow structure concavity.

2. The aerodynamic control system of claim 1 wherein the shadow structure is generally oval-shaped, the body portion of the aerodynamic control device extends through the shadow structure.

3. The aerodynamic control system of claim 1 wherein the shadow structure further has an apex region interposed between the inner and outer sloping regions.

4. The aerodynamic control system of claim 3 wherein the apex region is generally oval-shaped.

5. The aerodynamic control system of claim 3 wherein the aircraft fuselage generally defines a horizontal plane, the base portion is disposed below the apex region with respect to the horizontal plane.

6. The aerodynamic control system of claim 3 wherein the aircraft fuselage generally defines a horizontal plane, the aerodynamic control device further has a contour transition portion disposed generally between the body and base portions thereof, the apex region and the contour transition portion are cooperatively sized and configured to define positive angles with respect to the horizontal plane.

7. The aerodynamic control system of claim 1 wherein the body portion is disposed generally perpendicular to the base portion of the aerodynamic control device.

8. The aerodynamic control system of claim 1 wherein the aircraft fuselage generally defines a horizontal plane, the body portion is generally aligned perpendicular to the horizontal plane.

9. The aerodynamic control system of claim 1 wherein the fuselage generally defines a horizontal plane, the base portion is generally aligned parallel to the horizontal plane.

10. The aerodynamic control system of claim 1 wherein the inner sloping region defines a control device opening which is sized and configured to receive the body portion of the aerodynamic control device therethrough.

11. The aerodynamic control system of claim 10 wherein the aircraft fuselage generally defines a horizontal plane, the control device opening has a periphery which is generally aligned parallel to the horizontal plane.

12. The aerodynamic control system of claim 10 wherein the control device opening has a periphery, the base portion of the aerodynamic control device is sized and configured to slidably engage the periphery.

13. The aerodynamic control system of claim 10 wherein the control device opening has a periphery which is sized and configured to overlap the base portion of the aerodynamic control device.

14. The aerodynamic control system of claim 1 wherein the aerodynamic control device rotates relative to the aircraft fuselage.

15. The aerodynamic control system of claim 14 wherein the aircraft fuselage generally defines a horizontal plane, the aerodynamic control device has an axis of rotation which is generally orthogonal to the horizontal plane.

16. The aerodynamic control system of claim 14 further comprises an actuator attachable to the aerodynamic control device for rotating the aerodynamic control device relative to the aircraft fuselage.

17. The aerodynamic control system of claim 1 wherein the aerodynamic control device rotates relative to the shadow structure.

18. The aerodynamic control system of claim 1 wherein the body portion of the aerodynamic control device is an aircraft tail.

19. The aerodynamic control system of claim 1 wherein the shadow structure is formed of a radar absorptive material.

20. The aerodynamic control system of claim 1 wherein the aerodynamic control device is formed of a radar absorptive material.

21. The aerodynamic control system of claim 1 wherein the outer sloping region is attachable to the aircraft fuselage to form a relatively smooth airfoil surface thereat.

22. A low observable aircraft comprising:

an aircraft fuselage;

a shadow structure having an inner sloping region and an outer sloping region, the inner sloping region defining a shadow structure concavity, the outer sloping region being attached to the aircraft fuselage; and an aerodynamic control device having a body portion and a base portion, the base portion being disposed within the shadow structure concavity, the body portion extending from the base portion beyond the shadow structure concavity.

23. A low observable aerodynamic control system for integrated use with an aircraft fuselage, the control system comprising:

a pair of opposing shadow structures each having an inner sloping region and an outer sloping region, the inner sloping regions cooperatively defining a shadow structure concavity, the outer sloping regions being attachable to the aircraft fuselage; and an aerodynamic control device having a body portion and a base portion, the base portion being disposed within the shadow structure concavity, the body portion extending from the base portion beyond the shadow structure concavity.

24. The aerodynamic control system of claim 23 wherein body portion has a width, the shadow structures are generally elongate convex-shaped and extend along the width of the body portion.

25. The aerodynamic control system of claim 23 wherein the shadow structures have a curvature for capturing the body portion of the aerodynamic control device therebetween.

26. The aerodynamic control system of claim 23 wherein the shadow structures are connected to form a generally unitary member.

27. The aerodynamic control system of claim 23 wherein the shadow structures each further has an apex region interposed between the inner and outer sloping regions.

28. The aerodynamic control system of claim 27 wherein the aircraft fuselage generally defines a horizontal plane, the aerodynamic control device further has a contour transition portion disposed generally between the body and base portions thereof, the apex regions and the contour transition portion are cooperatively sized and configured to define positive angles with respect to the horizontal plane.

29. The aerodynamic control system of claim 23 wherein the aerodynamic control device rotates relative to the aircraft fuselage.

* * * * *